US006745750B2

(12) United States Patent
Egler et al.

(10) Patent No.: US 6,745,750 B2
(45) Date of Patent: Jun. 8, 2004

(54) FUEL INJECTION SYSTEM FOR INTERNAL COMBUSTION ENGINES

(75) Inventors: Walter Egler, Gerlingen (DE); Giovanni Ferraro, Ludwigsburg (DE); Hansjoerg Egeler, Fellbach (DE); Achim Brenk, Kaempfelbach-Bilfingen (DE); Wolfgang Klenk, Loechgau (DE); Peter Boehland, Marbach (DE); Werner Teschner, Stuttgart (DE); Sebastian Kanne, Stuttgart (DE); Ingolf Kahleyss, Marbach (DE); Uwe Gordon, Kemmern (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 3 days.

(21) Appl. No.: 10/182,561

(22) PCT Filed: Dec. 5, 2001

(86) PCT No.: PCT/DE01/04530

§ 371 (c)(1),
(2), (4) Date: Nov. 25, 2002

(87) PCT Pub. No.: WO02/46601

PCT Pub. Date: Jun. 13, 2002

(65) Prior Publication Data

US 2003/0127074 A1 Jul. 10, 2003

(30) Foreign Application Priority Data

Dec. 7, 2000 (DE) ..... 100 60 812

(51) Int. Cl.[7] ..... F02M 7/00
(52) U.S. Cl. ..... 123/447; 123/467
(58) Field of Search ..... 123/447, 467, 123/446, 506; 239/88

(56) References Cited

U.S. PATENT DOCUMENTS

| | | | | | |
|---|---|---|---|---|---|
| 4,957,275 | A | * | 9/1990 | Homes | 251/129.02 |
| 5,118,076 | A | * | 6/1992 | Homes | 251/129.02 |
| 5,901,685 | A | * | 5/1999 | Noyce et al. | 123/467 |
| 6,382,189 | B1 | * | 5/2002 | Hlousek | 123/506 |
| 6,561,165 | B1 | * | 5/2003 | Hlousek | 123/467 |

FOREIGN PATENT DOCUMENTS

| | | | |
|---|---|---|---|
| DE | DE 199 57 591 | A | 10/2000 |
| DE | 019958249 | A1 * | 11/2000 |
| DE | DE 199 58 249 | A | 11/2000 |
| EP | EP 0 995 902 | A | 4/2000 |
| EP | EP 1 030 052 | | 8/2000 |
| EP | 001030052 | A1 * | 8/2000 |

* cited by examiner

*Primary Examiner*—Mahmoud Gimie
(74) *Attorney, Agent, or Firm*—Ronald E. Greigg

(57) ABSTRACT

A fuel injection system, having a fuel injection valve and a control valve, which control valve has a control valve member that is longitudinally displaceable in a control valve bore. A control valve sealing face is embodied on the control valve member; it cooperates with a control valve seat and thus controls the communication between a first pressure space and a second pressure space; the first pressure space communicates with a high-pressure collection chamber. In a valve body, a bore is embodied in which a pistonlike valve needle, with its end toward the combustion chamber, controls the opening of at least one injection opening by executing a longitudinal motion in response to the pressure in a pressure chamber; the pressure chamber communicates with the second pressure space via an inlet conduit. The first pressure space communicates via a throttle with a damping chamber, embodied as a blind bore and otherwise closed off, as a result of which pressure fluctuations that occur upon closure of the control valve are rapidly damped.

20 Claims, 7 Drawing Sheets

FUEL INJECTION SYSTEM FOR INTERNAL COMBUSTION ENGINES

CROSS-REFERENCE TO RELATED APPLICATIONS

This application is a 35 U.S.C. 371 application of PCT/DE 01/04530, filed on Dec. 5, 2001.

BACKGROUND OF THE INVENTION

1. Field of the Invention

The invention is directed to an improved fuel injection system for internal combustion engines.

2. Description of the Prior Art

One fuel injection system of the type with which this invention is concerned is known for instance from German Patent Disclosure DE 197 01 879 A1 and includes a fuel tank, from which fuel is pumped into a high-pressure collection chamber by a high-pressure pump. In the high-pressure collection chamber, a predetermined high fuel pressure is maintained by means of a regulating device. From the high-pressure collection chamber, high-pressure supply lines corresponding in number to the number of combustion chambers of the engine each lead to one fuel injection valve, and the fuel injection valve can be made to communicate with the high-pressure supply line by a control valve. For reasons of space, the control valve and the fuel injection valve are often disposed in one housing. The fuel injection valve here includes a valve needle, which is guided in a bore and is surrounded, in the region toward the combustion chamber, by a pressure space. A pressure face is embodied on the valve needle and is acted upon by the fuel in the pressure space, so that when a certain opening pressure in the pressure space is reached, the valve needle executes a longitudinal motion counter to a closing force and thus opens at least one injection opening, through which fuel from the pressure space reaches the combustion chamber of the engine. The control valve of the fuel injection system is embodied as a 3/2-way valve, which in one position makes the high-pressure collection chamber communicate with the pressure chamber of the fuel injection valve, and in a second position interrupts the communication with the high-pressure collection chamber and causes the pressure chamber to communicate with a leak fuel chamber embodied in the valve body, which leak fuel chamber communicates with the fuel tank via a line, so that a low fuel pressure always prevails in the leak fuel chamber. If the control valve switches from the closed position to the opened position, a pressure wave is created, which passes through the inlet conduit into the pressure space, where it causes a pressure advantage; that is, the injection of the fuel takes place at a pressure which is markedly higher than the pressure in the high-pressure collection chamber. As a result, high injection pressures are obtained at a moderate high pressure in the high-pressure collection chamber and in the parts of the fuel injection system that carry the high fuel pressure. Since the fuel in the supply lines is in motion through the opened control valve during the injection, it is stopped abruptly upon closure of the control valve, and so the kinetic energy of the fuel is converted into compression work. This creates pressure fluctuations, which upon a second injection immediately following the first makes precise and exact metering of the injection quantity difficult, since because of the pressure fluctuations, the state of the control valve is not precisely known.

It is therefore the object of the present invention to construct a fuel injection system such that precise metering of the injection quantity and precisely definable main injections, preinjections and postinjections are made possible.

SUMMARY OF THE INVENTION

The fuel injection system of the invention has the advantage over the prior art that the pressure fluctuations that occur upon closure of the control valve, that is, upon the interruption of the communication with the high-pressure collection chamber, are damped by the communication of the first pressure space or the high-pressure supply line with a damping chamber via a throttle, and thus fade quickly. After closure, the control valve therefore quickly regains a steady state, making it possible within a short time interval from the preceding injection to perform a second injection and thus to control its injection quantity quite precisely. The control valve is a 3/2-way valve in a control valve body and contains a control valve member, which is longitudinally displaceably guided along a control bore. By radially widening the control bore, two pressure spaces are embodied in the control bore; the first pressure space communicates with the high-pressure collection chamber, and the second pressure space communicates with the pressure chamber embodied in the fuel injection valve. In the closing position of the control valve member, the communication between the first and second pressure space is interrupted, and the second pressure space and thus the pressure chamber communicate with a leak fuel chamber and are thus pressureless. In the opening position of the control valve member, the communication between the first and second pressure space is opened, and the communication of the second pressure space with the leak fuel chamber is interrupted, so that the high-pressure collection chamber communicates with the pressure chamber.

The first pressure space communicates with a damping chamber via a throttle, and so pressure fluctuations of the kind that occur upon opening and closure of the control valve in the first pressure space and also in the high-pressure supply line are damped. By a suitable design of the throttle, the damping characteristic can be selected such that pressure fluctuations in the pressure space already fade completely after only a few fluctuation periods.

In a first advantageous feature of the subject of the invention, the damping chamber is embodied as a bore, which extends in the valve holding body parallel to the longitudinal axis thereof. As a result, the damping chamber can be realized in the already known fuel injection valves without rebuilding, and without having to change the outer diameter of the fuel injection valve.

In a further advantageous feature, the valve holding body is axially braced against the control valve body with the interposition of a shim. The bore forming the damping chamber extends partly inside the control valve body, through the shim, and for a greater part in the valve holding body. The throttle is embodied in the shim, so that by replacing the shim with one having a different throttle, the fuel injection valve can be adapted to given requirements without having to make structural changes in the rest of the fuel injection valve.

In a further advantageous feature of the subject of the invention, the damping chamber comprises two parallel bore portions, both extending in the valve holding body. The two bore portions of the damping chamber communicate with one another through a transverse conduit, so that a shorter valve holding body can be achieved, for the same volume of the throttle bore.

In a further advantageous feature, the two bore portions of the damping chamber communicate through a transverse conduit which is disposed in a shim that in turn is disposed between the valve holding body and the valve body. As a result, a transverse connection of the bore portions inside the valve holding body, which can be fabricated only at relatively great effort and expense, for instance using an end-milling cutter, is unnecessary. Embodying the transverse connection in the shim makes it possible for both bore portions of the damping chamber to be embodied originating on one of the face ends of the valve holding body.

In a further advantageous feature, at least two throttles are disposed in the line that connects the damping chamber with the high-pressure supply line. As a result of the two throttles, a markedly more powerful throttling is obtained than with only one throttle, so that the two throttles can have a substantially larger flow cross section than a single throttle with the same damping action. This makes the risk that the throttles will become plugged with dirt particles in the fuel much less. It is especially advantageous for the two throttles not to be disposed in a line, aligned with one another, but offset radially from one another, which additionally reinforces the damping action.

In a further advantageous feature of the subject of the invention, a closing valve is disposed between the damping chamber and the first pressure space; it opens the communication between the first pressure space and the damping chamber only whenever damping is desired. The pressure advantage upon opening of the control valve that is desired for the sake of injection at the highest possible pressure is reduced somewhat because of the constant communication between the first pressure space and the damping chamber. The closing valve therefore interrupts the communication between the first pressure space and the damping chamber during the opening phase of the control valve. After the termination of injection, the closing valve is opened, so that the pressure waves are damped quickly, as before, in the first pressure space. Thus by means of this closing valve, an optimal injection pressure and simultaneously a damping of the pressure fluctuations are obtained, which makes exact metering of the injections possible.

In another advantageous feature, the closing valve is controlled by the pressure in the second pressure space. With the control valve opened, at least approximately the same pressure prevails in the second pressure space as in the first pressure space, and the closing valve is closed by that pressure. If the control valve closes the communication between the first pressure space and the second pressure space, then the pressure in the second pressure space drops, and the closing valve as a result opens the communication between the first pressure space and the damping chamber. The damping of the pressure fluctuation then ensues as already described. The control by the pressure in the second pressure space makes an additional electronic triggering of the closing valve unnecessary.

In a further advantageous feature of the subject of the invention, the control valve body is fabricated from a hard steel, while the valve holding body in which the damping chamber is embodied is fabricated from a relatively soft steel. The control valve, which contains sealing faces that are subjected to severe stress, is disposed in the control valve body. Because it is made of a hard steel, wear in the region of the valve seat of the control valve is reduced. To embody the valve holding body, conversely, a soft steel is advantageous, since no seat or sealing faces are provided in it, and thus there is no severe mechanical stress. The hollow chamber that forms the damping chamber can be made economically and quickly in the soft steel.

BRIEF DESCRIPTION OF THE DRAWINGS

In the drawing, various exemplary embodiments of the fuel injection system of the invention are shown. Shown are FIG. 1, a fuel injection valve in longitudinal section and the high-pressure fuel supply in its schematic structure.

DESCRIPTION OF THE PREFERRED EMBODIMENTS

Figure 1:
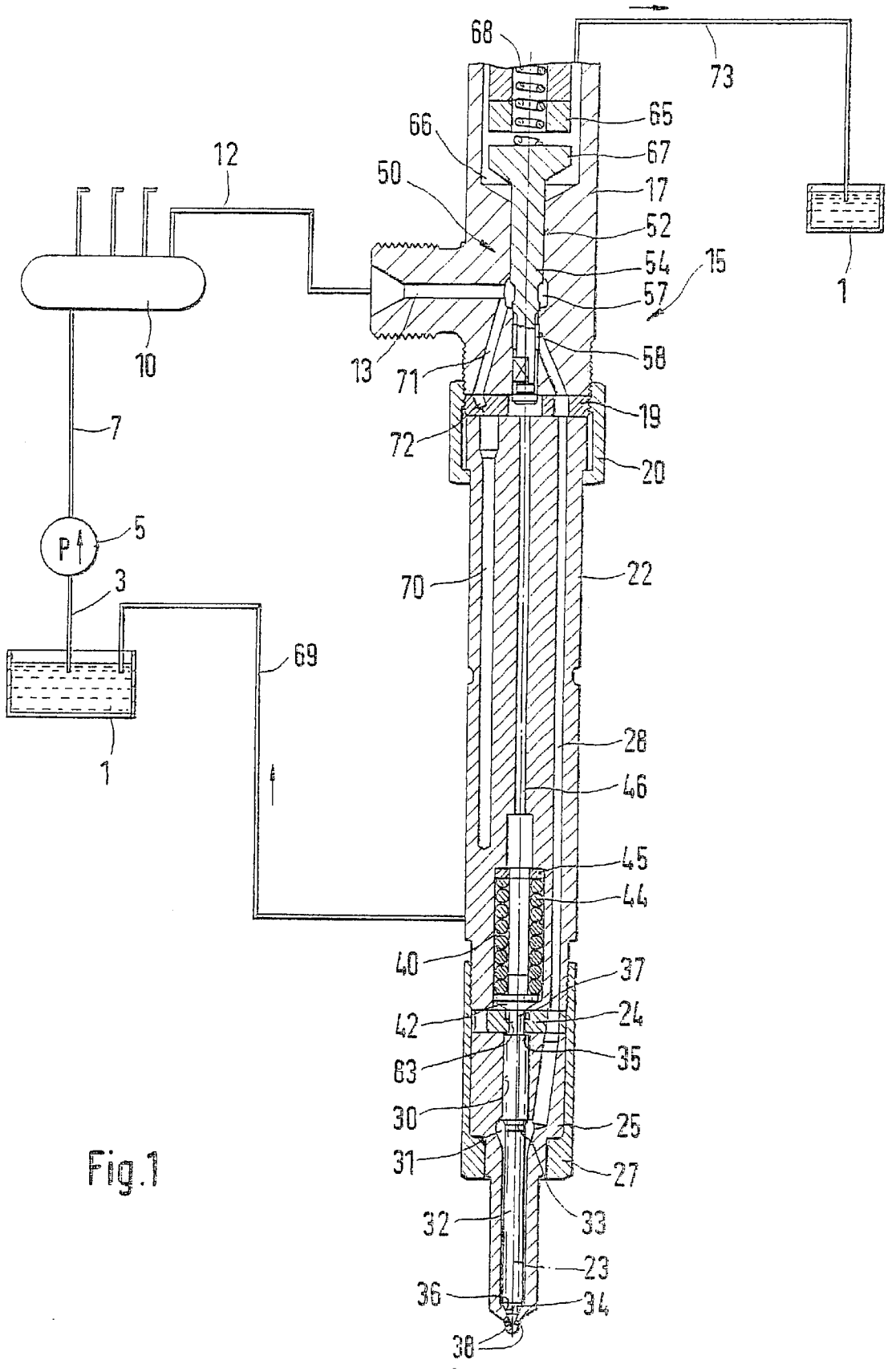

In FIG. 1, a fuel injection valve of the invention is shown in longitudinal section, which together with the high-pressure fuel supply shown schematically and the leak fuel system, also shown only schematically, forms a fuel injection system. From a fuel tank 1, fuel is supplied via a fuel line 3 to a high-pressure pump 5, which pumps the fuel at high pressure via a supply line 7 into a high-pressure collection chamber 10. In the high-pressure collection chamber 10, by means of a regulating device not shown in the drawing, a predetermined high fuel pressure is maintained. Leading away from the high-pressure collection chamber 10 are high-pressure supply lines 12, which each communicate with one fuel injection valve 15, one of which is shown as an example in the drawing. The fuel injection valve 15 is constructed in multiple parts and includes a control valve body 17, in which a control valve 50 is disposed. A valve holding body 22 is axially braced against the control valve body 17 by means of a locknut 20, with the interposition of a shim 19. On the other end of the valve holding body 22, pointing toward the combustion chamber, the valve holding body 22 rests, with the interposition of a valve shim 24, on a valve body 25, which valve body 25 is braced by a locknut 27 against the valve holding body 22. In the valve body 25, a bore 30 is embodied, on whose end toward the combustion chamber a substantially conical valve seat 36 is embodied, in which at least one injection opening 38 is disposed. In the bore 30, a pistonlike valve needle 32 is disposed, which is guided sealingly in a portion, remote from the combustion chamber, of the bore 30 and which narrows toward the combustion chamber, forming a pressure face 33. On its end toward the combustion chamber, the valve needle 32 changes into a substantially conical valve sealing face 34, which cooperates with the valve seat 36 and thus in the closing position, that is, upon contact with the valve seat 36, closes th injection openings 38. At the level of the pressure face 33, a pressure chamber 31 is formed by a radial widening of the bore 30; this chamber continues in the form of an annular conduit, surrounding the valve needle 32, as far as the valve seat 36. The pressure chamber 31 can be made to communicate with the high-pressure collection chamber 10 via an inlet bore 28, extending in the valve body 25, the valve shim 24, the valve holding body 22, the shim 19 and the control valve body 17, and can thus be filled with fuel at high pressure.

A central opening 83 is embodied in the valve shim 24 and causes the bore 30 to communicate with a spring chamber 40 embodied in the valve holding body 22. The spring chamber 40 is embodied here as a bore and is disposed coaxially to the bore 30. The central opening 83 has a smaller diameter than the bore 30 that guides the valve needle 32, so that a stop shoulder 35 is formed at the transition from the valve body 25 to the valve shim 24. The axial spacing between the face end, remote from the combustion chamber, of the valve needle 32 and the stop shoulder 35 of the valve shim 24, in the closing position of the fuel injection valve, defines the opening stroke of the valve needle 32.

On its end remote from the combustion chamber, the valve needle 32 merges with a pressure pin 37, which is disposed coaxially with the valve needle 32 and is disposed in the central opening 83 of the valve shim 24. The pressure pin 37 changes over to a spring plate 42, disposed in the spring chamber 40, and between this spring plate and the end, remote from the combustion chamber, of the spring chamber, a closing spring 44 embodied as a helical compression spring is disposed, prestressed with pressure. The pressure prestressing of the closing spring 44 can be defined by way of the thickness of a compensation disk 45, which is disposed between the closing spring 44 and the end, remote from the combustion chamber, of the spring chamber 40. By the force of the closing spring 44, via the spring plate 42 and the pressure pin 37, the valve needle 32 is pressed with the valve sealing face 34 against the valve seat 36, and the injection openings 38 are thus closed. The spring chamber 40 communicates with the fuel tank 1 via a leak fuel line 69, so that fuel that has entered the spring chamber 40 is carried away to the fuel tank 1, and a low fuel pressure therefore always prevails in the spring chamber 40. On its end remote from the combustion chamber, the spring chamber 40 merges with a through bore 46, disposed coaxially to the bore 30 and the spring chamber 40, which extends as far as the inside of a diversion chamber 76 embodied in the shim 19.

Figure 2:
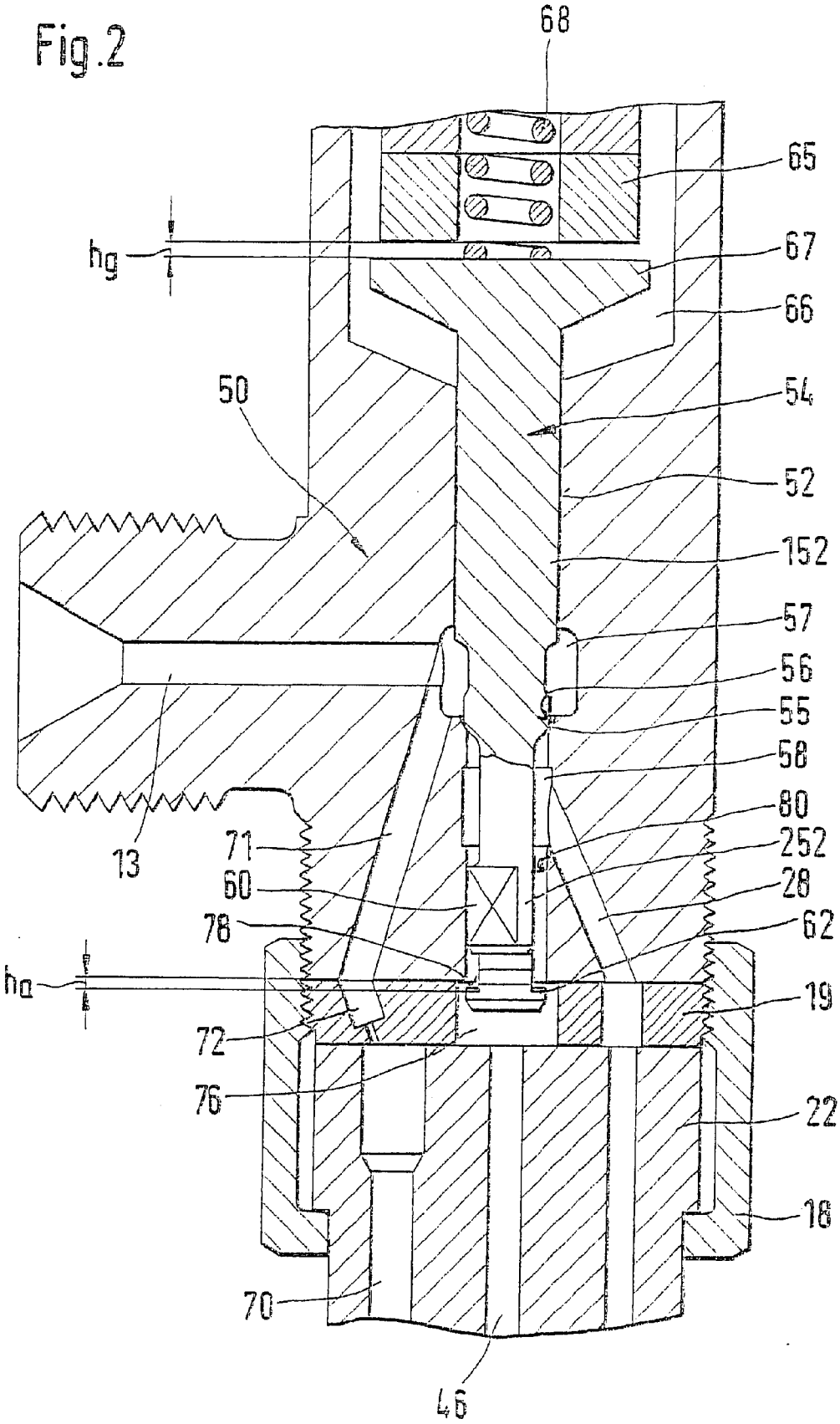
FIG. 2, an enlargement of FIG. 1 in the region of the control valve.

In FIG. 2, an enlarged view of the control valve 50 is shown in longitudinal section. The control valve bore 52 is subdivided into a sealing portion 152 and a smaller-diameter guide portion 252. Remote from the combustion chamber, the control valve bore 52 discharges into a leak fuel chamber 66, embodied in the control valve body 17, and by its other end it discharges into the diversion chamber 76, which communicates with the spring chamber 40 via the through bore 46. By radially widening the control valve bore 52, a first pressure space 57 is formed, which communicates with the high-pressure supply line 12 and thus with the high-pressure collection chamber 10 via an inlet conduit 13 embodied in the control valve body 17. Beginning at the first pressure space 57, toward the valve holding body 22, a second pressure space 58 is formed by a further radial widening of the control valve bore 52. The inlet bore 28, which connects the second pressure space 58 with the pressure chamber 31, discharges into the second pressure space 58. At the transition from the first pressure space 57 to the second pressure space 58, a substantially conical control valve seat 56 is formed on the wall of the control valve bore 52. A control valve member 54, which is sealingly guided in the sealing portion 152 of the control valve member 50, is disposed longitudinally displaceably in the control valve bore 52. From the sealingly guided portion of the control valve member 54, the control valve member 54 narrows toward the valve holding body 22, forming a control valve sealing face 55, which is embodied substantially conically and cooperates with the control valve seat 56. The control valve member 54 extends through the second pressure space 58 into the diversion chamber 76, embodied in the shim 19, where the control valve member 54 merges with a control portion 62 that is embodied cylindrically and has a diameter that is only slightly smaller than the diameter of the guide bore 252 of the control valve bore 52. Between the control portion 62 and the second pressure space 58, the control valve member 54 is guided in the guide bore 252 of the control valve bore 52, and recesses 60 are embodied in the control valve member 54, so that fuel can flow past the guided portion of the control valve member 54. The annular end face 78, oriented toward the control valve body 17, of the control portion 62 has an axial spacing from the beginning of the control valve bore 52 that is equivalent to a diversion stroke $h_a$, in the closing position of the control valve member 54 or in other words when the control valve sealing face 55 is resting on the control valve seat 56.

On the end remote from the valve holding body 22, the control valve member 54 changes over into a magnet armature 67, which is disposed in the leak fuel chamber 66, and the leak fuel chamber 66 communicates with the fuel tank 1 via a leak fuel line 73. In the closing position of the control valve member 54, the magnet armature 67 has an axial spacing $h_g$ from an electromagnet 65 that is also disposed in the leak fuel chamber 66. The electromagnet 65 surrounds a valve spring 68, which is disposed, prestressed, between a fixed stop, not shown in the drawing, and the magnet armature 67 and which urges the control valve member 54 into the closing position. The electromagnet 65 is disposed in stationary fashion in the leak fuel chamber 66 and if supplied with suitable current can exert an attracting force on the magnet armature 67, which as a result is pulled in the opening direction of the control valve member 54 until it comes into contact with the electromagnet 65. This opening stroke motion of the control valve member 54 takes place counter to the closing force of the valve spring 68, so that upon elimination of the current supplied to the electromagnet 65, the control valve member 54 is pressed into the closing position again by the valve spring 68.

Besides the inlet conduit 13, a line embodied as a connecting conduit 71 also discharges into the first pressure space 57. The connecting conduit 71 extends in inclined fashion relative to the longitudinal axis of the control valve member 54 as far as the shim 19. In the shim 19, a throttle 72 is embodied, by way of which the connecting conduit 71 communicates with a damping chamber 70 embodied in the valve holding body 22. The damping chamber 70 is embodied here as a blind bore, which extends parallel to the longitudinal axis 23 of the valve holding body 22 and to the through bore 46. The blind bore that forms the damping chamber 70 can have various lengths, depending on the desired volume of the damping chamber 70. It is also possible for the blind bore that forms the damping chamber 70 to be embodied with various diameters.

Figure 3:
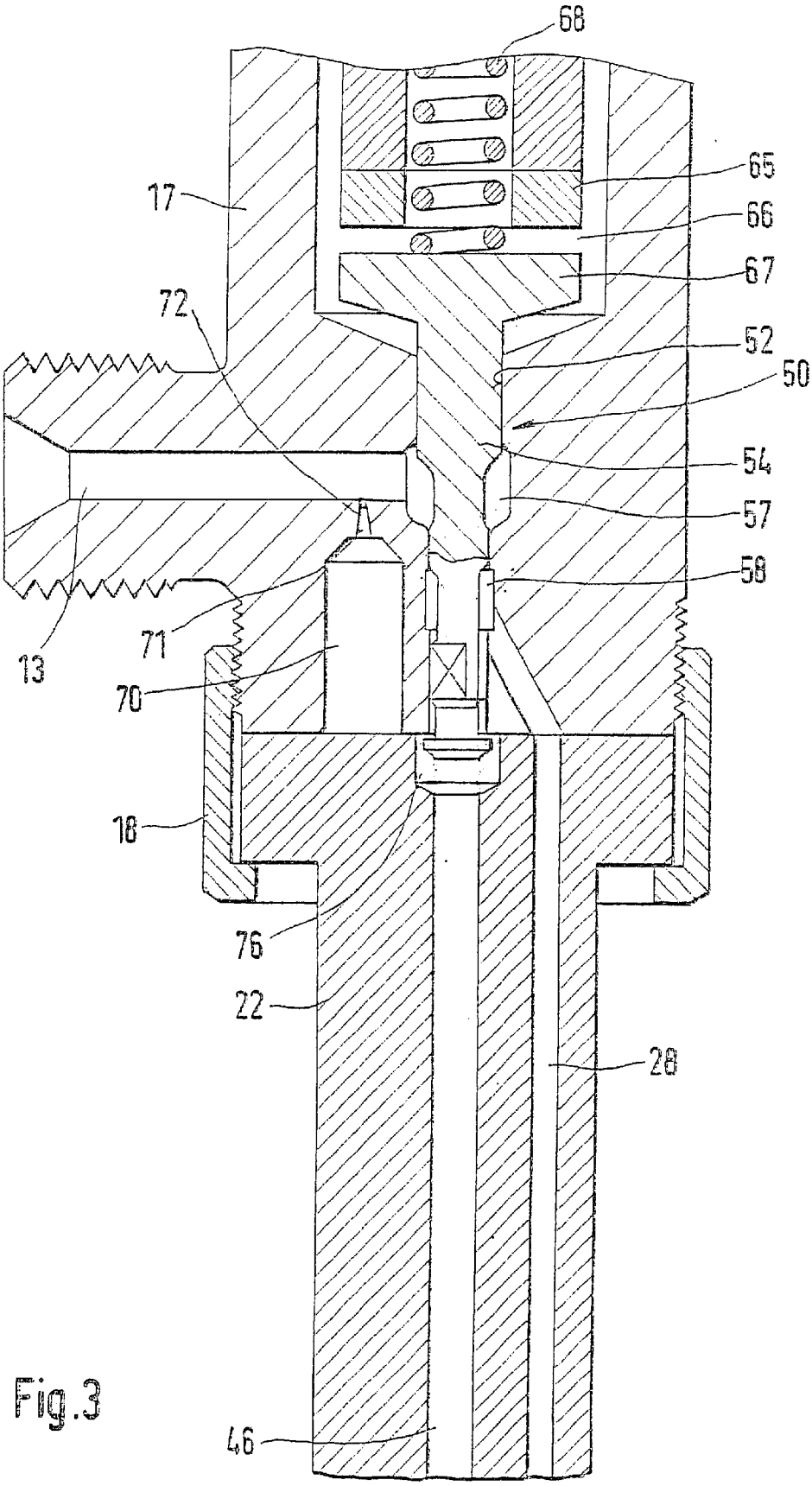
FIG. 3, the same detail as FIG. 2 for a further exemplary embodiment.

In FIG. 3, a further exemplary embodiment of the fuel injection system of the invention is shown, with the same enlargement of the detail as shown in FIG. 2. The function and structure are precisely equivalent to the exemplary embodiment shown in FIG. 2, except that here the damping chamber 70 is represented by a recess in the control valve body 17 which is embodied cylindrically and extends parallel to the control valve bore 52. The damping chamber 70 communicates with the inlet conduit 13 near the first pressure space 57 via a line that is embodied as a connecting conduit 71. Inside the connecting conduit 71, a throttle 72 is disposed which damps the flow of fuel through the connecting conduit 71. Since the damping chamber 70, including the connecting conduit 71 and the throttle 72, is disposed inside the control valve body 17, the valve holding body 22 need not be structurally changed compared to a fuel injection valve without a damping chamber 70.

Figure 4:
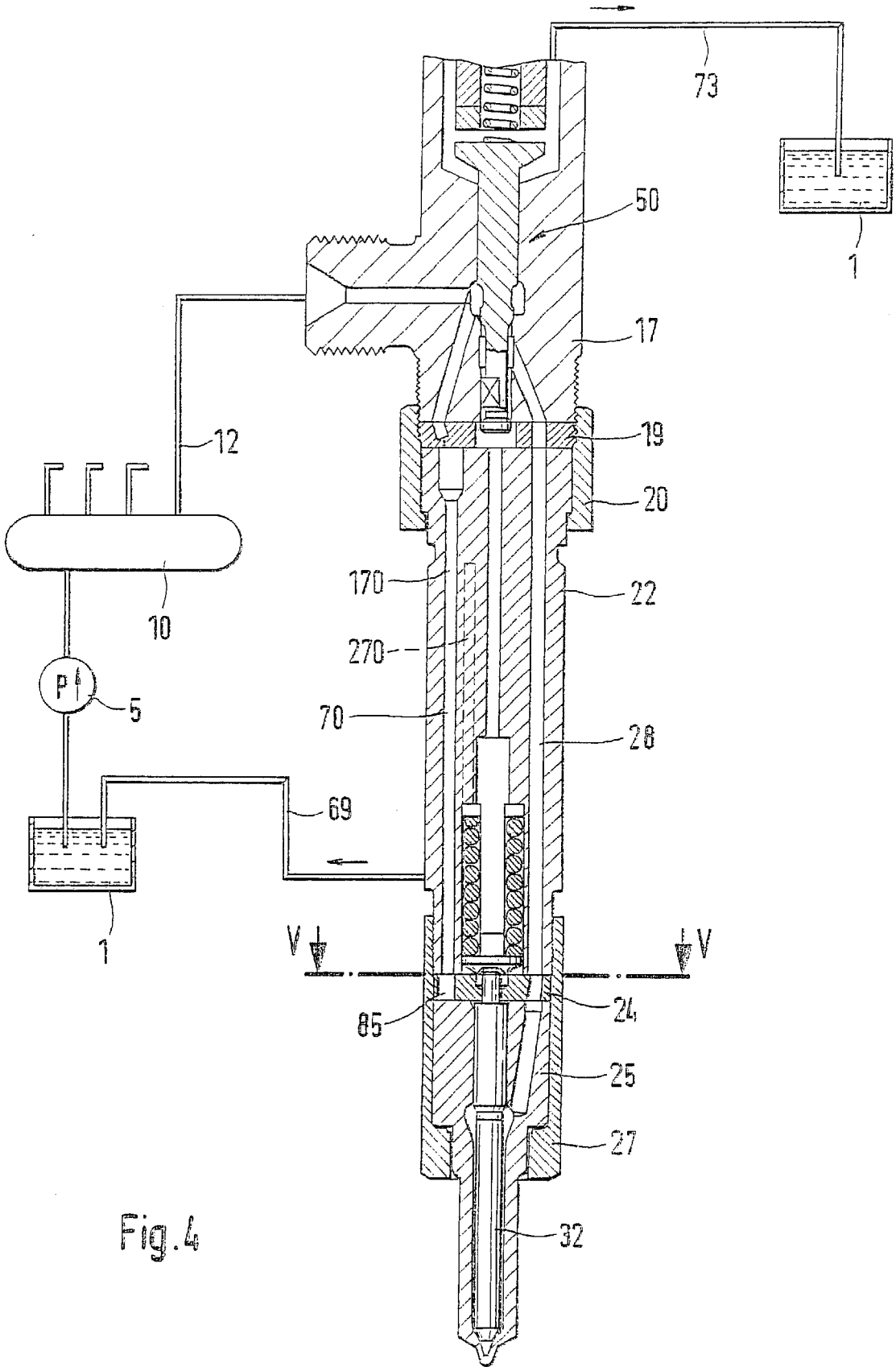
FIG. 4, a further exemplary embodiment of a fuel injection system, in the same view as FIG. 1.
Figure 5:
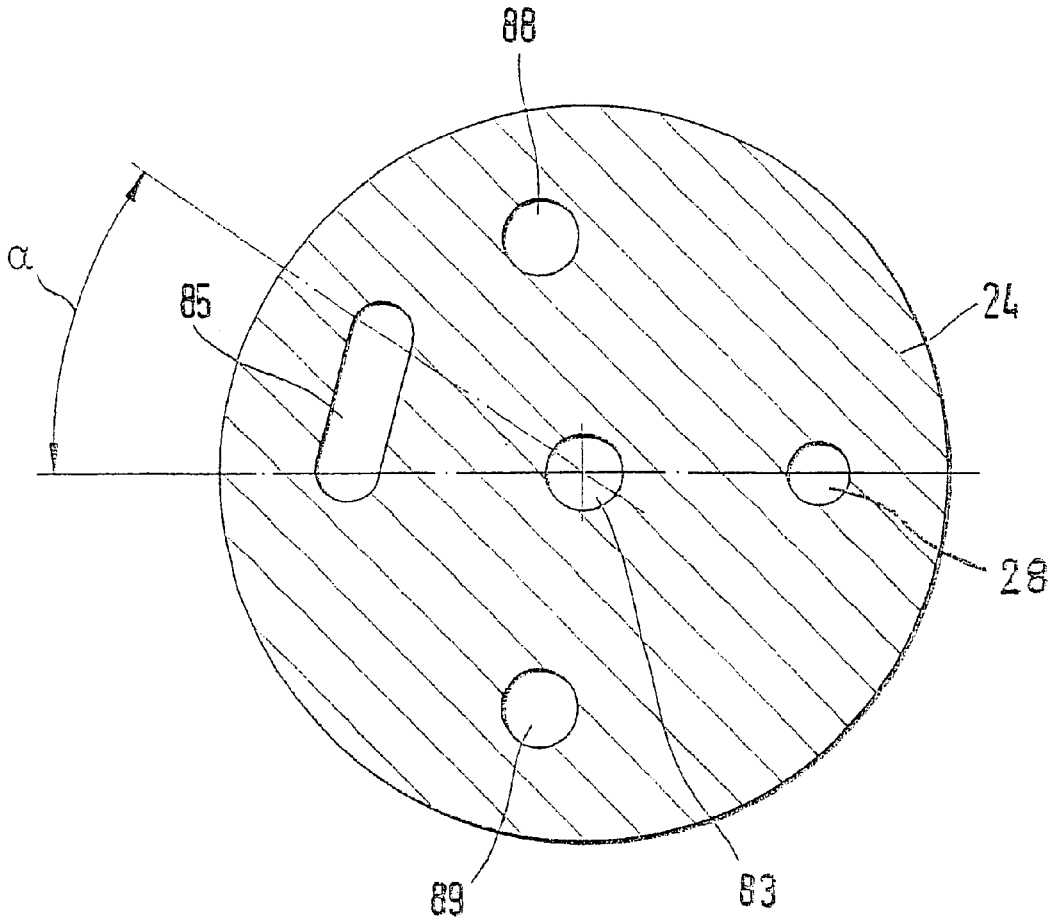
FIG. 5, a cross section through the fuel injection valve shown in FIG. 4, taken alone the line V—V.

In FIG. 4, a further exemplary embodiment of a fuel injection system of the invention is shown; compared to FIG. 1, only the embodiment of the damping chamber 70 is changed. In this exemplary embodiment, the damping chamber 70 is not embodied as a simple blind bore; instead, it is subdivided into two bore portions 170, 270, which are embodied parallel to one another in the valve holding body 22. The first bore portion 170 of the damping chamber 70 extends from one face end of the valve holding body 22 to the other, or in other words from the shim 19 to the valve shim 24. In the valve shim 24, the first bore portion 170 of the damping chamber discharges into a transverse connection 85, which is oval or kidney-shaped in cross section, as FIG. 5 shows in a cross section through the valve shim 24. In the valve holding body 22, from the face end of the valve holding body 22 toward the combustion chamber, a second bore portion 270 of the damping chamber 70 is formed, which is embodied as a blind bore, and which second bore portion 270 is offset relative to the first bore portion 170 by an angle $\alpha$ about the longitudinal axis 23 of the valve holding body 22. By means of the transverse connection 85 in the valve shim 24, the two bore portions 170 and 270 communicate with one another, so that together they form the damping chamber 70.

In FIG. 5, a cross section through the fuel injection valve taken along the line V—V of FIG. 4 is shown. In addition to the central opening 83 and the transverse connection 85, two further centering pin bores 88 and 89 are also formed in the valve shim 24. In the assembly of the fuel injection valve, centering pins are inserted into these centering pin bores 88 and 89; the pins dip into corresponding bores in the valve holding body 22 and the valve body 25 and thereby assure an exact positioning of these bodies to one another.

The mode of operation of the fuel injection system as shown in FIGS. 1–5 is as follows: Through the fuel line 3, the high-pressure pump 5 pumps fuel out of the fuel tank 1 via a high-pressure supply line 7 into the high-pressure collection chamber 10. In the high-pressure collection chamber 10, by a regulating device not shown in the drawing, a predetermined, high fuel pressure level is maintained. In the high-pressure collection chambers that are usual at present, the pressure level amounts to as much as 140 MPa. From the high-pressure collection chamber 10, the fuel is carried through the high-pressure supply lines 12 to the fuel injection valves 15. In the fuel injection valve 15, the fuel passes through the inlet conduit 13 into the first pressure space 57. At the onset of the injection cycle, the control valve 50 is in the closing position; that is, there is no current to the electromagnet 65, and the control valve member 54 is pressed with its control valve sealing face 55 against the control valve seat 56 by the valve spring 68 and closes the first pressure space 57 off from the second pressure space 58. The second pressure space 58 communicates via the recesses 60 with the diversion chamber 76, which through the through bore 46 is in communication with the spring chamber 40, which communicates with the fuel tank 1. In this way, in the second pressure space 58 and, via the inlet bore 28 that originates at the second pressure space 58, in the pressure chamber 31 as well, a low fuel pressure prevails, which is equivalent to the pressure in the fuel tank 1. In the damping chamber 70, because of the connecting conduit 71, the same pressure prevails as in the first pressure space 57, and thus also the same pressure as in the high-pressure collection chamber 10. If an injection is to occur, current is supplied to the electromagnet 65, causing the magnet armature 67 to move toward the electromagnet 65, counter to the force of the valve spring 68. As a result of the motion of the magnet armature 67, the control valve member 54 also moves, and the control valve sealing face 55 lifts from the control valve seat 56. As a result, the first pressure space 57 communicates with the second pressure space 58. As long as the diversion stroke $h_a$ has not yet been executed by the control valve member 54, the second pressure space 58 continues to communicate with the diversion chamber 76 via the recesses 60, so that at the onset of the reciprocating motion of the control valve member 54, fuel flows out of the first pressure space into the second pressure space 58 and from there into the diversion chamber 76. As a result, the fuel quantity, which is at high pressure in the inlet conduit 13, is set into motion and kinetic energy is thus imparted to it. Once the diversion stroke $h_a$ has been executed, the control portion 62 dips into the control valve bore 52 and thus closes off the second pressure space 58 from the diversion chamber 76. The fuel that is already in motion in the inlet conduit 13 now flows into the inlet bore 28 and on into the still-closed pressure chamber 31, where the kinetic energy of the fuel is converted into compression work. This causes a pressure increase in the pressure chamber 31, and a markedly higher pressure is obtained than in the high-pressure collection chamber 10. This pressure can be several tens of MPa above the pressure in the high-pressure collection chamber 10. The pressure in the pressure chamber 31 creates a hydraulic force on the pressure face 33 of the valve needle 32, which as a result is moved axially away from the combustion chamber, counter to the force of the closing spring 44. As a result, the valve sealing face 34 also lifts from the valve seat 36, and the injection openings 38 are opened, so that fuel from the pressure chamber 31 flows past the valve needle 32 to the injection openings 38 and from there is injected into the combustion chamber of the engine. The valve needle 32 continues its opening stroke motion until such time as its face end, remote from the combustion chamber, rests on the stop shoulder 35 of the valve shim 24. If the injection is to be terminated, the electromagnet 65 is no longer supplied with current, causing the valve spring 68 to press the control valve member 54 back into the closing position. In the course of the closing motion of the control valve member 54, the control portion 62 reemerges from the guide bore 252 of the control valve bore 52 and causes the second pressure space 58, and thus via the inlet bore 28 the pressure chamber 31 as well, to communicate with the diversion chamber 76, which communicates with the leak fuel system. The pressure chamber 31 is thus relieved, and the force of the closing spring 44 on the valve needle 32 overcomes the hydraulic force on the pressure face 33, and the valve needle 32 moves back into the closing position. Since the fuel in the inlet conduit 13 still has kinetic energy, this kinetic energy is converted, after the closure of the control valve 50, into compression work, so that the pressure in the first pressure space 57 rises. As a result of this pressure advantage, a higher pressure prevails in the first pressure space 57 than in the damping chamber 70, so that fuel now flows out of the first pressure space 57 through the connecting conduit 71 and the throttle 72 into the damping chamber 70, where the pressure is as a result increased accordingly. The pressure wave thus flowing into the damping chamber 70 therefore reduces the pressure in the first pressure space 57 and increases the pressure in the damping chamber 70, until the pressure in the damping chamber 70 is higher than in the first pressure space 57. Some of the fuel flows back through the throttle 72 and the connecting conduit 71 from the damping chamber 70 into the first pressure space 57, where the pressure rises again accordingly. This pressure fluctuation is damped by the throttle 72, so that in contrast to fuel injection systems without corresponding damping, the pressure fluctuation has already faded after only a few fluctuations, and a constant pressure which is equivalent to the pressure in the high-pressure collection chamber 10 again prevails in the first pressure space 57. Via the cross section of the throttle 72 and the volume of the damping chamber 70, the intensity of the damping can be adapted to the requirements of the fuel injection valve.

Figure 6:
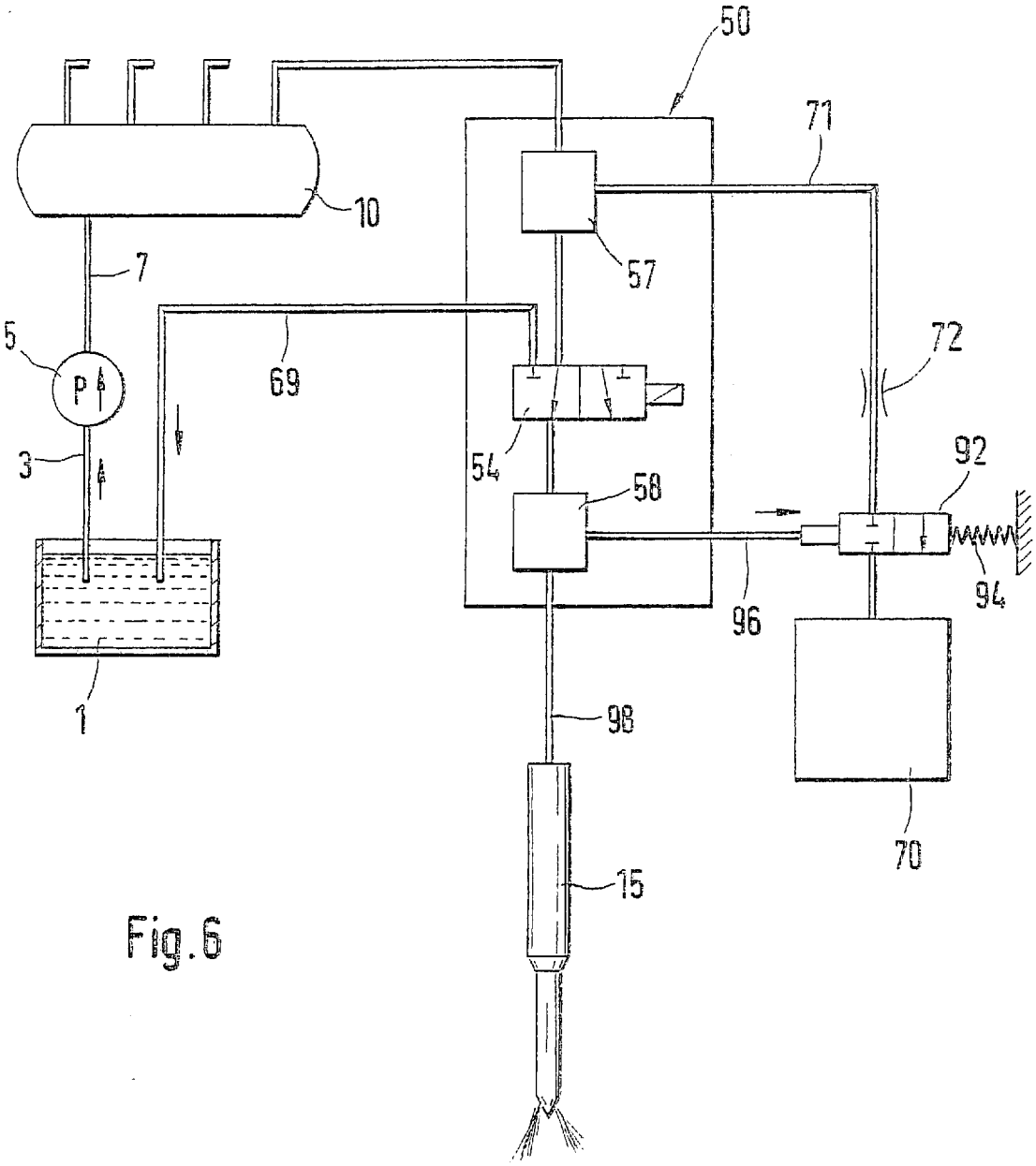
FIG. 6, a further exemplary embodiment of a fuel injection system of the invention, shown schematically.

In FIG. 6, a further exemplary embodiment of the fuel injection system of the invention is shown in the form of a schematic block circuit diagram. The mode of operation of the control valve 50, as in the exemplary embodiments described above, is that of a 3/2-way valve, which correspondingly connects the first pressure space 57, the second pressure space 58, and the leak fuel line 69. The first pressure space 57 communicates with the damping chamber via a connecting conduit 71 and a throttle 72; in this exemplary embodiment, a closing valve 92 is disposed between the throttle 72 and the damping chamber 70. The closing valve 92 is controlled by the force of a spring 94 and by the pressure in the second pressure space 58, which pressure acts on the closing valve 92 via a connecting line 96. If a high enough fuel pressure, which exerts a greater force on the closing valve 92 than the spring 94 does, prevails in the second pressure space 58, then the closing valve 92 will interrupt the connecting conduit 71, and the damping chamber 70 no longer communicates with the first pressure space 57, so that a pressure fluctuation that occurs in the first pressure space 57 is no longer damped. If the fuel pressure in the second pressure space 58 is low enough, as is the case when the control valve 50 is closed, then the force of the spring 94 overcomes the force of the fuel pressure in the second pressure space, and the closing valve 92 opens the communication between the first pressure space 57 and the damping chamber 70.

The advantage of the closing valve 92 is that pressure fluctuations in the first pressure space 57 are damped only whenever the control valve 50 is closed, or accordingly only whenever no injection is taking place. Specifically, if the first pressure space 57 communicates constantly with the damping chamber 70 via the throttle 72, then the desired pressure surge at the onset of injection will also be damped somewhat, so that the maximum attainable pressure advantage in the pressure chamber 31 comes to be somewhat less than in the case of a closed-off first pressure space 57 that otherwise has no damping. By means of the closing valve 92, a higher injection pressure is thus obtained, for the same pressure in the high-pressure collection chamber 10. The closing valve 92 is advantageously also embodied here in the control valve body 17, so that a compact design of the fuel injection system is still possible, and the switching of the closing valve 92 is not delayed by an unnecessarily long connecting line 96.

Besides the disposition of the throttle 72 in the shim 19, it can also be provided that the throttle restriction be embodied in the control valve body 17 or in the valve holding body 22. To that end, the shim 19 can be omitted, which thus dispenses with one high-pressure sealing face. In that case, the diversion chamber will correspondingly be disposed in the valve holding body 22. It can also be provided that the damping chamber 70 is embodied by two bore portions 170, 270, but the communication of the bore portions 170, 270 is embodied not in the valve shim 24 but in the valve holding body 22. As a result, a damping chamber is obtained that in longitudinal section is at least approximately U-shaped. This kind of damping chamber can be produced with the aid of an end-milling cutter, for instance. It can also be provided that the closing valve 92 be controlled not by the pressure in the second pressure space 58 but rather directly, for instance with the aid of an electric actuator that is triggered by a control unit.

It can moreover be provided that the damping chamber 70 be embodied not as a bore but rather as an arbitrary hollow chamber in the valve holding body 22, and that it be made to communicate with the first pressure space 57 via a throttled connection. Such a damping chamber can be adapted optimally to the space available in the valve holding body 22. It is furthermore possible also to embody the damping chamber 70 in the control valve body 17, thus dispensing with a corresponding high-pressure sealing face of the kind embodied between the shim 19 and the valve holding body 22, or between the control valve body 17 and the shim 19.

It can also be provided that the control valve 50 be controlled not directly with the aid of an electromagnet, as shown in the exemplary embodiments here. Alternatively, the control valve member 54 can be controlled by a device which puts the control valve member 54 in the opening or closing position with the aid of hydraulic forces.

The control valve seat 56 of the control valve 50 is subjected to high mechanical stress, because of the seating impact of the control valve sealing face 55 upon the longitudinal motion of the control valve member 54. It is therefore necessary to fabricate the control valve body 17 of a hard, wear-resistant steel. By comparison, embodying the damping chamber 70 as a blind bore in the valve holding body 22 made of a hard steel is possible only at considerable effort and expense. Since no mechanically highly stressed surfaces are present in the valve holding body 22, the valve holding body 22 can be fabricated from a relatively soft steel, in which bores can easily be made.

Figure 7:
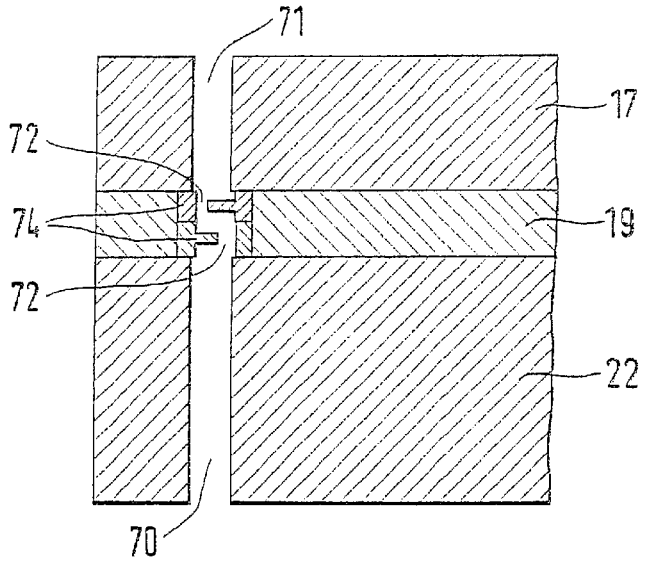
FIG. 7, an enlarged view of FIG. 1 in the region of the shim.

In FIG. 7, an enlargement of FIG. 1 is shown schematically in the region of the shim 19; however, here there are two throttles 72 in the shim 19. Two throttle disks 74 are inserted into the shim 19, which each have one bore eccentrically forming the throttle 72. The throttles 72 are offset from one another, so that they are not aligned. The fuel, which upon damping of the pressure waves flows through the throttles 72, must accordingly make a sharp change in direction twice, which considerably increases the damping action of the throttles 72. For this reason, the cross section of the throttles 72 can be selected as larger than in the version with only one throttle 72, thus markedly lessening the risk that the throttle 72 will become plugged up with dirt particles.

Figure 8:
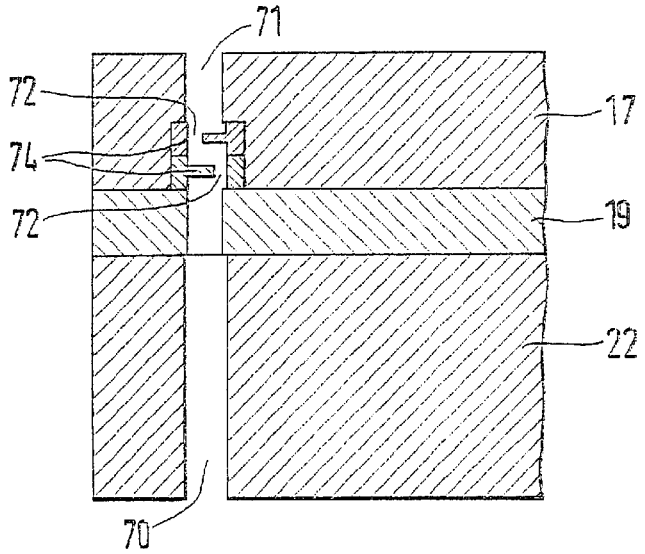
FIG. 8, the same detail as FIG. 7, for a further exemplary embodiment.

In FIG. 8, a further exemplary embodiment with two throttles 72 in the connecting conduit 71 is shown. Here, the throttle disks 74 are disposed in the control valve body 17, so that the shim 19 and the valve holding body 22 do not contain any throttling devices. The disposition of the throttle disks 74 and the throttles 72 relative to one another is identical to the exemplary embodiment shown in FIG. 7.

Figure 9:
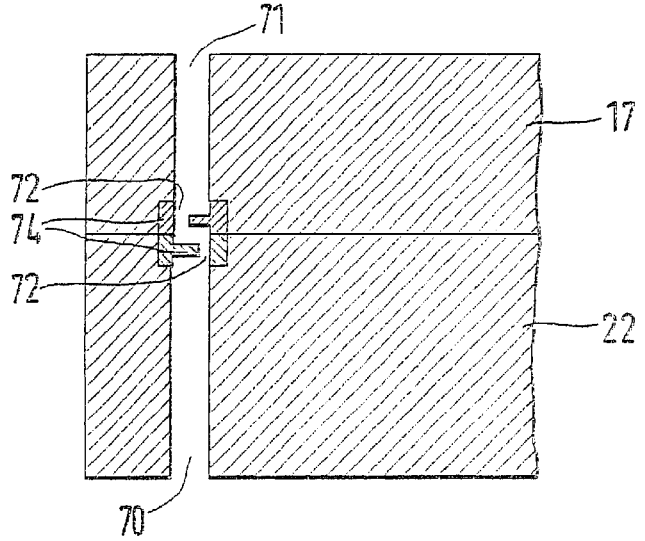
FIG. 9, the same detail as FIG. 7, for a further exemplary embodiment.

In FIG. 9, a further exemplary embodiment of a fuel injection system with two throttles 72 is shown. One throttle disk 74 each, and thus also one throttle 72 each, is disposed in the control valve body 17 and in the valve holding body 22; in this exemplary embodiment, the control valve body 17 rests directly on the valve holding body 22.

Along with the exemplary embodiments shown in FIGS. 7, 8 and 9, it can also be provided that the throttles 72 are distributed in some other combination among the control valve body 17, the shim 19, and the valve holding body 22. It can also be provided that more than two throttles 72 are disposed in the connecting conduit 71, and these throttles can again be distributed as needed among the control valve body 17, shim 19, and valve holding body 22.

The foregoing relates to preferred exemplary embodiments of the invention, it being understood that other variants and embodiments are possible within the spirit and scope of the invention, the latter being defined by the appended claims.

We claim:

1. A fuel injection system for internal combustion engines, comprising a fuel injection valve, which is supplied from a high-pressure fuel source and has a valve member (32) that is adjustable by means of the pressure of a pressure chamber (31) embodied in the fuel injection valve and as a result controls at least one injection opening (38) that can be made to communicate with the pressure chamber (31), a control valve (50), which has a control valve member (54) that in a first position disconnects a first pressure space (57), communicating constantly with the high-pressure fuel source, from an inlet bore (28) leading to the pressure chamber (31) and in a second position opens the communication between the high-pressure fuel source and the pressure chamber (31), and a line (71) having a throttle (72) between the high-pressure fuel source and the first pressure space (57), the line (71) leading to an otherwise closed-off damping chamber (70), the damping chamber (70) being embodied as a blind bore.

2. The fuel injection system of claim 1 wherein the line (71) leads from the first pressure space (57) to the damping chamber (70).

3. The fuel injection system of claim 1 wherein the fuel injection valve has a control valve body (17), a valve holding body (22), and a valve body (25), the control valve body (17) and the valve body (25) being disposed on opposite face ends of the valve holding body (22), the control valve (50) being disposed in the control valve body (17), and the valve member (32) being disposed in the valve body (25).

4. The fuel injection system of claim 3 wherein the control valve body (17) is axially braced against the valve holding body (22), and the damping chamber (70) is embodied in the valve holding body (22).

5. The fuel injection system of claim 4 wherein the throttle (72) is disposed in the control valve body (17).

6. The fuel injection system of claim 4 wherein the throttle (72) is disposed in the valve holding body (22).

7. The fuel injection system of claim 4 further comprising a shim (19) in which the throttle (72) is embodied, the shim being disposed between the control valve body (17) and the valve holding body (22).

8. The fuel injection system of claim 1 wherein at least two throttles (72) are disposed in the line (71).

9. The fuel injection system of claim 8 wherein the throttles (72) are embodied by bores in throttle disks (74), and the throttle disks (74) are disposed in the same radial plane as the line (71).

10. The fuel injection system of claim 9 wherein the throttles (72) are disposed offset from one another in the radial direction of the throttle disks (74).

11. The fuel injection system of claim 4 wherein the damping chamber (70) comprises two bore portions (170; 270) parallel to one another, the two bore portions communicating with one another.

12. The fuel injection system of claim 11 wherein both bore portions (170; 270) of the damping chamber (70) communicate through a transverse connection embodied in the valve holding body (22).

13. The fuel injection system of claim 11 wherein the valve body (25) is axially braced against the valve holding body (22) with the interposition of a valve shim (24), and wherein a transverse connection (85) that connects the bore portions (170; 270) of the damping chamber (70) to one another is embodied in the valve shim (24).

14. The fuel injection system of claim 1 wherein the control valve body (17) is fabricated from a harder steel than the valve holding body (22).

15. The fuel injection system of claim 3 wherein the control valve body (17) is fabricated from a harder steel than the valve holding body (22).

16. The fuel injection system of claim 4 wherein the control valve body (17) is fabricated from a harder steel than the valve holding body (22).

17. The fuel injection system of claim 9 wherein the control valve body (17) is fabricated from a harder steel than the valve holding body (22).

18. The fuel injection system of claim 1 wherein the high-pressure fuel source is a high-pressure collection chamber (10).

19. The fuel injection system of claim 14 wherein the high-pressure fuel source is a high-pressure collection chamber (10).

20. The fuel injection system of claim 15 wherein the high-pressure fuel source is a high-pressure collection chamber (10).

* * * * *